US011743637B2

(12) United States Patent
Fischer et al.

(10) Patent No.: US 11,743,637 B2
(45) Date of Patent: Aug. 29, 2023

(54) METHOD FOR DIRECTIONAL SIGNAL PROCESSING IN AN ACOUSTIC SYSTEM

(71) Applicant: Sivantos Pte. Ltd., Singapore (SG)

(72) Inventors: Eghart Fischer, Schwabach (DE); Johannes Zeitler, Gerhardshofen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/412,677

(22) Filed: Aug. 26, 2021

(65) Prior Publication Data

US 2022/0070579 A1 Mar. 3, 2022

(30) Foreign Application Priority Data

Aug. 26, 2020 (DE) ..... 10 2020 210 805.6

(51) Int. Cl.
*H04R 1/40* (2006.01)
*H04R 3/00* (2006.01)

(52) U.S. Cl.
CPC ..... *H04R 1/406* (2013.01); *H04R 3/005* (2013.01)

(58) Field of Classification Search
CPC ..... H04R 1/406; H04R 3/005
USPC ..... 381/91, 92
See application file for complete search history.

(56) References Cited

U.S. PATENT DOCUMENTS

| | | | | |
|---|---|---|---|---|
| 3,199,949 | A1 | 6/2012 | Fischer et al. | |
| 10,412,507 | B2 | 9/2019 | Fischer | |
| 2007/0076901 | A1* | 4/2007 | Fischer | H04R 1/406 381/91 |
| 2019/0075405 | A1* | 3/2019 | Fischer | H04R 25/552 |
| 2019/0158963 | A1* | 5/2019 | Best | H04R 25/505 |
| 2021/0044908 | A1* | 2/2021 | Fischer | H04R 25/407 |

FOREIGN PATENT DOCUMENTS

| | | | |
|---|---|---|---|
| DE | 102006047986 | A1 | 4/2008 |
| DE | 102017215823 | B3 | 9/2018 |
| DE | 102019211943 | A1 | 2/2021 |

* cited by examiner

*Primary Examiner* — William A Jerez Lora
(74) *Attorney, Agent, or Firm* — Laurence A. Greenberg; Werner H. Stemer; Ralph E. Locher

(57) ABSTRACT

A method for directional signal processing for an acoustic system, wherein first and second input transducers generate a first and a second input signal from an ambient sound. First and second intermediate signals are generated from the first and second input signal, wherein a preliminary superposition parameter is obtained for a first superposition of the first intermediate signal and the second intermediate signal in such a way that for the first superposition an attenuation in a first target direction has a maximum. A superposition parameter is formed from the preliminary superposition parameter so that a second superposition of the first and second intermediate signals, formed in the first target direction with the superposition parameter, has a pre-specified first value for a gain that is greater than zero. An output signal of the acoustic system is formed from the second superposition.

13 Claims, 4 Drawing Sheets

METHOD FOR DIRECTIONAL SIGNAL PROCESSING IN AN ACOUSTIC SYSTEM

CROSS-REFERENCE TO RELATED APPLICATION

This application claims the priority, under 35 U.S.C. § 119, of German patent application DE 102020210805.6, filed Aug. 26, 2020; the prior application is herewith incorporated by reference in its entirety.

FIELD AND BACKGROUND OF THE INVENTION

The invention relates to a method for directional signal processing for an acoustic system, as well as to a corresponding such system. A first input signal is generated from an ambient sound by a first input transducer of the acoustic system. A second input signal is generated from the ambient sound by a second input transducer of the acoustic system. A first intermediate signal and a second intermediate signal are generated from the first input signal and the second input signal respectively. A superposition parameter is obtained for a superposition of the first intermediate signal and the second intermediate signal in such a way that for the superposition an attenuation in a first target direction has a maximum. An output signal of the acoustic system is formed from the superposition.

For hearing aids and also for communication devices, directional signal processing can significantly improve a signal-to-noise ratio (SNR) in certain acoustic environments, i.e. a specific arrangement of useful signal sources with specific spectral properties and a simultaneous presence of specific sources of interference signals. Often, adaptive interference signals are suppressed by a targeted alignment of a directional characteristic of an output signal, formed on the basis of intermediate signals, to a dominant useful signal source, usually by minimizing the signal energy of the output signal under the secondary condition of a fixed alignment of one of the intermediate signals to the useful signal source.

An important exemplary implementation here is an adaptive directional microphone, in which the intermediate signals each achieve a largely complete cancellation of an interference signal in a specific interference signal direction, for example, as a cardioid or anti-cardioid signal, so that a weighted superposition of the said intermediate signals can be optimized with regard to the signal energy via a corresponding superposition parameter. In this case, the optimal solution usually provides an output signal in which a strongly directional interference signal source is almost completely suppressed.

However, for reasons relating to spatial auditory perception, but also for safety reasons, it is often not desirable to completely suppress an interference signal source if it originates from another road user in road traffic, for example, and should therefore be generally perceived and preferably also remain able to be localized.

SUMMARY OF THE INVENTION

It is accordingly an object of the invention to provide a method for directional signal processing for an acoustic system which overcomes various disadvantages of the heretofore-known devices and methods of this general type and which specifies a method for directional signal processing by which a strongly directional source of interference signals is not completely suppressed, but in particular, remains audible in an output signal of the acoustic system.

With the above and other objects in view there is provided, in accordance with the invention, a method for directional signal processing in an acoustic system, the method comprising:

generating a first input signal from an ambient sound with a first input transducer of the acoustic system;

generating a second input signal from the ambient sound with a second input transducer of the acoustic system;

using the first input signal and the second input signal to generate a first intermediate signal and a second intermediate signal, respectively;

obtaining a preliminary superposition parameter for a first superposition of the first intermediate signal and the second intermediate signal to form the first superposition with an attenuation having a maximum in a first target direction;

forming with the preliminary superposition parameter a superposition parameter such that a second superposition of the first intermediate signal and the second intermediate signal, formed in the first target direction using the superposition parameter, has a prespecified first value for a gain that is greater than zero; and forming an output signal of the acoustic system using the second superposition.

In other words, the objects of the invention are achieved by a method for directional signal processing for an acoustic system, wherein a first input signal is generated from the ambient sound by a first input transducer of the acoustic system, a second input signal is generated from the ambient sound by a second input transducer of the acoustic system, a first intermediate signal and a second intermediate signal being generated from the first input signal and the second input signal respectively, wherein a, in particular real-valued, preliminary superposition parameter is obtained for a first superposition of the first intermediate signal and the second intermediate signal in such a way that for the first superposition an attenuation in a first target direction has a maximum, a superposition parameter being formed from the preliminary superposition parameter in such a way that a second superposition of the first intermediate signal and the second intermediate signal, formed in the first target direction using the superposition parameter, has a pre-specified first value for a gain that is greater than zero, and wherein an output signal of the acoustic system is formed from the second superposition. Advantageous embodiments, some of which are inventive in themselves, are the subject matter of the dependent claims and the following description.

An acoustic system in this context includes any arrangement of a plurality of input transducers for generating and further processing corresponding input signals, in particular a hearing aid, a hearing aid connected by Bluetooth or similar to a smartphone and/or a smartwatch, or else a communication system for recording speech signals, e.g. in the context of conferences or similar.

An input transducer in this case comprises an acousto-electrical transducer which is configured to generate a corresponding electrical signal from an acoustic signal. In particular, the generation of the first or second input signal by the respective input transducer can also include a pre-processing stage, for example, in the form of a linear pre-amplification and/or an A/D conversion. The input signal generated accordingly is formed in particular by an electrical signal, the current and/or voltage fluctuations of which essentially represent the sound pressure fluctuations of the air.

The first intermediate signal and the second intermediate signal are preferably each generated as directional signals which have different directional characteristics from each other, wherein the directional characteristics are symmetrical to each other, in particular with respect to a preferred plane of the acoustic system. Such a preferred plane can be defined in particular by the arrangement of the first and second input transducers relative to each other, and/or by their use as intended, such as a frontal plane of a user if the acoustic system is a hearing aid. The first intermediate signal can be generated in particular by means of a time-delayed superposition of the first input signal with the second input signal, and/or from a superposition of the input signals filtered with different filters. The directional characteristic of the first intermediate signal has at least one minimum direction in which the attenuation assumes a global minimum (across all directions) and therefore the sensitivity of the first intermediate signal in the minimum direction is a minimum, as well as at least one maximum direction in which the sensitivity of the first intermediate signal (across all directions) is a maximum. A similar situation applies to the second intermediate signal.

The preliminary superposition parameter is now obtained in particular by superimposing the first intermediate signal with the second intermediate signal, the latter weighted with a free weighting factor, and for the said first superposition the free weighting factor is varied in such a way that the first superposition in a first target direction exhibits a maximum, in particular almost total, attenuation. The first target direction is preferably given by the direction of a first interference signal source. In this case, the maximum attenuation can be achieved, for example, by minimizing the signal energy of the signal resulting from the said superposition, in particular if the second intermediate signal in a direction of a dominant useful signal source, to which the first intermediate signal is preferably aligned, has the maximum possible attenuation (i.e., in particular, the maximum direction of the first intermediate signal coincides with the minimum direction of the second intermediate signal).

The value of the weighting factor for which the desired maximum attenuation occurs is used as a preliminary superposition parameter for the first superposition. However, an explicit signal-based generation of the first superposition is not absolutely necessary for the determination of the preliminary superposition parameter if the directional characteristics of the first and second intermediate signals are known, since, for example, in that case it is possible to tabulate them as a function of the input levels of the first and second intermediate signals, the preliminary superposition parameter being tabulated in such a way that a correspondingly generated first superposition would have the desired attenuation.

The superposition parameter for the second superposition of the two intermediate signals is now calculated using the preliminary superposition parameter in such a way that in the first target direction, in which the attenuation of the first superposition has an in particular global maximum and is preferably as large as possible, in other words it can be described in particular as almost total suppression, the gain assumes the prespecified first value greater than zero. This means in particular that in the first target direction, the attenuation is no longer total or approximately total, but finite, which means that an acoustic signal from the first interference signal source will now remain audible in the output signal.

The formation of the superposition parameter a for the second superposition, which in particular can have the form $U2=Z1-a\cdot Z2$ with the first or second intermediate signal Z1 or Z2, using the preliminary superposition parameter $a_0$ which is obtained from the first superposition $U1=Z1-a_0\cdot Z2$, can now be achieved in particular by the fact that the superposition parameter a is complex, i.e., $a=aRe+i\cdot aIm$, with the real part aRe and the imaginary part aIm. This gives an additional degree of freedom for the second superposition U2. While a real-valued preliminary superposition parameter $a_0$ is fully specified by the condition that a maximum attenuation should be present in the first target direction, using the additional degree of freedom, which is provided by a generally complex-valued superposition parameter a, the first value g1 of the gain in the first target direction can also be specified for the second superposition.

Depending on which secondary condition is additionally placed on the second superposition, the real part aRe and the imaginary part aIm of the superposition parameter can be represented in particular as functions of the preliminary superposition parameter $a_0$ and of the first value g1 for the gain in the first target direction.

A cardioid signal is preferably generated as the first intermediate signal and an anti-cardioid signal as the second intermediate signal. These signals have the advantage of symmetry with respect to each other, that the minimum direction of the anti-cardioid signal (that is, the direction of minimum sensitivity and thus maximum attenuation) coincides with the maximum direction of the cardioid signal (that is, the direction with maximum sensitivity) and vice versa. In addition, in the ideal case both signals exhibit a complete attenuation in their respective minimum direction. Moreover, these signals can easily be generated from time-delayed superpositions of the two input signals by taking the acoustic propagation time between the two input transducers as the delay time. The resulting cardioid and anti-cardioid signal in the ideal case have a rotational symmetry around the connecting line through the two input transducers.

The superposition parameter a is conveniently formed in such a way that for the second superposition $U2=Z1-a\cdot Z2$, the gain in the first target direction has a global minimum with the prespecified first value g1. If the two input signals E1, E2 are represented in the frequency domain as a function of the ambient sound X, then from knowledge of how they were generated, the intermediate signals Z1, Z2 can be represented in the frequency domain as a function of the incidence direction φ of the ambient sound X as $Z1(\omega)=f(\varphi,\omega)\cdot X(\omega)$ (and similarly for Z2, where f (φ, w) takes into account corresponding phases, among other things, in the case of a time-delayed superposition). From this, a transfer function with respect to the ambient sound X can be determined for the second superposition $U2(\omega)$. The transfer function is then itself direction-dependent, due to the directional dependence of the intermediate signals.

It proves to be advantageous if the real part aRe of the superposition parameter $a=aRe+i\cdot aIm$ is formed from a linear function of the preliminary superposition parameter $a_0$ that is dependent on the first value g1 of the gain in the first target direction, which merges into the preliminary superposition parameter $a_0$ when the first value g1 approaches zero, and/or wherein the imaginary part aIm of the superposition parameter a is linearly dependent on the said real part aRe and approaches zero when the first value g1 approaches zero.

A linear function of the preliminary superposition parameter $a_0$ for the superposition parameter a allows a uniform treatment of all spatial directions which are represented by the individual preliminary superposition parameters $a_0$ (corresponding to the first superposition and its first target direction of maximum, preferably total, attenuation). For g1 close to zero, the superposition parameter merges into the preliminary superposition parameter $a_0$ provided for the first target direction, which allows for the fact that a complete attenuation (i.e. g1=0) of this should preferably take place in the first target direction.

The linear function for the real part aRe of the superposition parameter a can in particular have the form $$aRe = \frac{a_0 - \varepsilon}{1 + \varepsilon}$$

where $a_0$ denotes the preliminary superposition parameter, and c is a (preferably continuous) function of g1 with ε=0 for g1=0. It is particularly preferred that $\varepsilon = g\mathbf{1}^2/(1-g\mathbf{1}^2)$. The imaginary part aIm of the superposition parameter is given in particular by $aIm=\pm(aRe+1)\cdot\sqrt{\varepsilon}$.

Preferably, the superposition parameter is formed in such a way that for the second superposition the gain in the first target direction has the prespecified first value and has a prespecified second value in a second target direction. In particular, the second value is less than the first value and/or equal to zero.

An additional degree of freedom is introduced into the generation of the second superposition (compared to a purely real-valued superposition parameter) by means of a generally complex-valued superposition parameter. On the one hand, this allows the first value g1 of the gain to be set for the first target direction. Since the choice of the first target direction is a priori free, the relationship thus specified between the first target direction and the gain to be applied there places a first condition on the complex superposition parameter, which due to its imaginary part leaves a further degree of freedom. This degree of freedom can then be used to specify a second value g2 for the gain in a second target direction. This can be set as g2=0, or as 0<g2<g1, so that the second value sets a global minimum for the gain but a total attenuation does not occur in any direction.

The real part aRe and the imaginary part aIm of the superposition parameter a=aRe+i·aIm can preferably be described by means of a circle in the complex plane with the preliminary superposition parameter $a_0$ as origin and a radius ρ, the square $\rho^2$ of which is quadratically dependent on the first value g1 of the gain and quadratically dependent on the preliminary superposition parameter $a_0$. In particular, the dependency can be of the form $$(aRe-a_0)^2+a/m^2=g1^2\cdot(a_0+1)^2$$

with $\rho^2=g\mathbf{1}^2\cdot(a_0+1)^2$.

The superposition parameter a is preferably formed in such a way that the signal resulting from the second superposition has a maximum directionality index (DI). The DI can be determined using the maximum squared magnitude of a transfer function G(ω,ϕ) for the signal resulting from the second superposition (in the maximum direction $\phi_0$) with respect to an incident sound signal, normalized over the integral of the squared magnitude of the transfer function across all spatial directions. The DI is usually defined by the logarithm to base ten of the variables mentioned:

$$DI(\omega, (\phi), \theta) = 10 \cdot \log_{10}\left(\frac{|G(\omega, \phi = \phi_0, \theta = \pi/2)|^2}{\int d\Omega |G(\omega, \Omega)|^2}\right)$$

where the integration in the denominator takes place over the normalized unit sphere, so that for an omnidirectional signal DI=0 is obtained.

In particular, the superposition parameter a=aRe is real-valued, and particularly preferably has the form $a=aRe=a_0\pm g\mathbf{1}\cdot(a_0+1)$. The plus sign is preferably selected for $a_0<0.5$, the minus sign preferably for $a_0>0$.

Preferably, in a given environment of the preliminary superposition parameter $a_0$ around a critical value of in particular 0.5, a regularization of the superposition parameter is carried out in such a way that an applicable value of the superposition parameter a is specified for the critical value of the preliminary superposition parameter $a_0$, and that for values from the specified environment $[a_0-d1, a_0+d2]$ around the critical value (in particular with d1=d2), the preliminary superposition parameter $a_0$ is continuously mapped to the superposition parameter a. In particular, for the critical value of the preliminary environment parameter $a_0$, the real part aRe of the superposition parameter a can be specified in such a way that the DI is maximized by the assigned real part aRe at the critical value of $a_0$. This can be achieved by calculating the above-mentioned DI as a function of aRe and $aIm=\sqrt{\rho^2-(aRe-a_0)^2}$ with $\rho^2=g\mathbf{1}^2\cdot(a_0+1)^2$ and maximizing with respect to aRe for the critical value of $a_0$ (in particular $a_0=0.5$).

It also proves advantageous if the superposition parameter is formed in such a way that for the second superposition the gain in the first target direction has the prespecified first value, and has a prespecified second value in a second target direction, with the gain in the second target direction having a global minimum with the prespecified second value. In particular, the second value g2 for the global minimum of the gain across all spatial directions can be greater than zero, so that no total attenuation occurs in any spatial direction. This allows a defined gain (via the first value g1) to be ensured in the first direction of the target, which can be given by the direction of a dominant interference signal source, for example, so that the corresponding interference signal always remains audible in the output signal with the first value g1, and in addition, a total attenuation of possible further interference signals can be prevented.

With the above and other objects in view there is also provided, in accordance with the invention, an acoustic system, comprising at least one first input transducer for generating a first input signal from an ambient sound and a second input transducer for generating a second input signal from the ambient sound, in addition to a control unit which is configured for carrying out the described method. The method according to the invention shares the advantages of the acoustic system according to the invention. The advantages specified for the method and for its extensions can be transferred mutatis mutandis to the acoustic system.

Preferably, the acoustic system comprises a hearing aid in which the first input transducer and the second input transducer are arranged. In particular, the control unit is also arranged in the hearing aid. The hearing aid is preferably designed as a local device which is worn by a user on one of their ears. However, the control unit can also be implemented at least partially on a device associated with the hearing aid, e.g. a smartphone connected to the hearing aid via Bluetooth or similar.

In particular, the hearing aid may also be designed as a binaural hearing aid with two local devices, wherein the user wears one of the two local devices on each ear for the operation of the hearing aid. The first input transducer and the second input transducer are preferably arranged in one of the two local units in such a way that a cardioid signal or an anti-cardioid signal can be generated as the first or second intermediate signal using the corresponding first and second input signal respectively. In the case of a binaural hearing aid, the control unit for carrying out the method may also be distributed over both local devices and be implemented by their respective signal processing devices.

Other features which are considered as characteristic for the invention are set forth in the appended claims.

Although the invention is illustrated and described herein as embodied in method for directional signal processing for an acoustic system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

Identical and equivalent elements and dimensions are identified with the same reference signs throughout the figures.

DETAILED DESCRIPTION OF THE INVENTION

Figure 1:
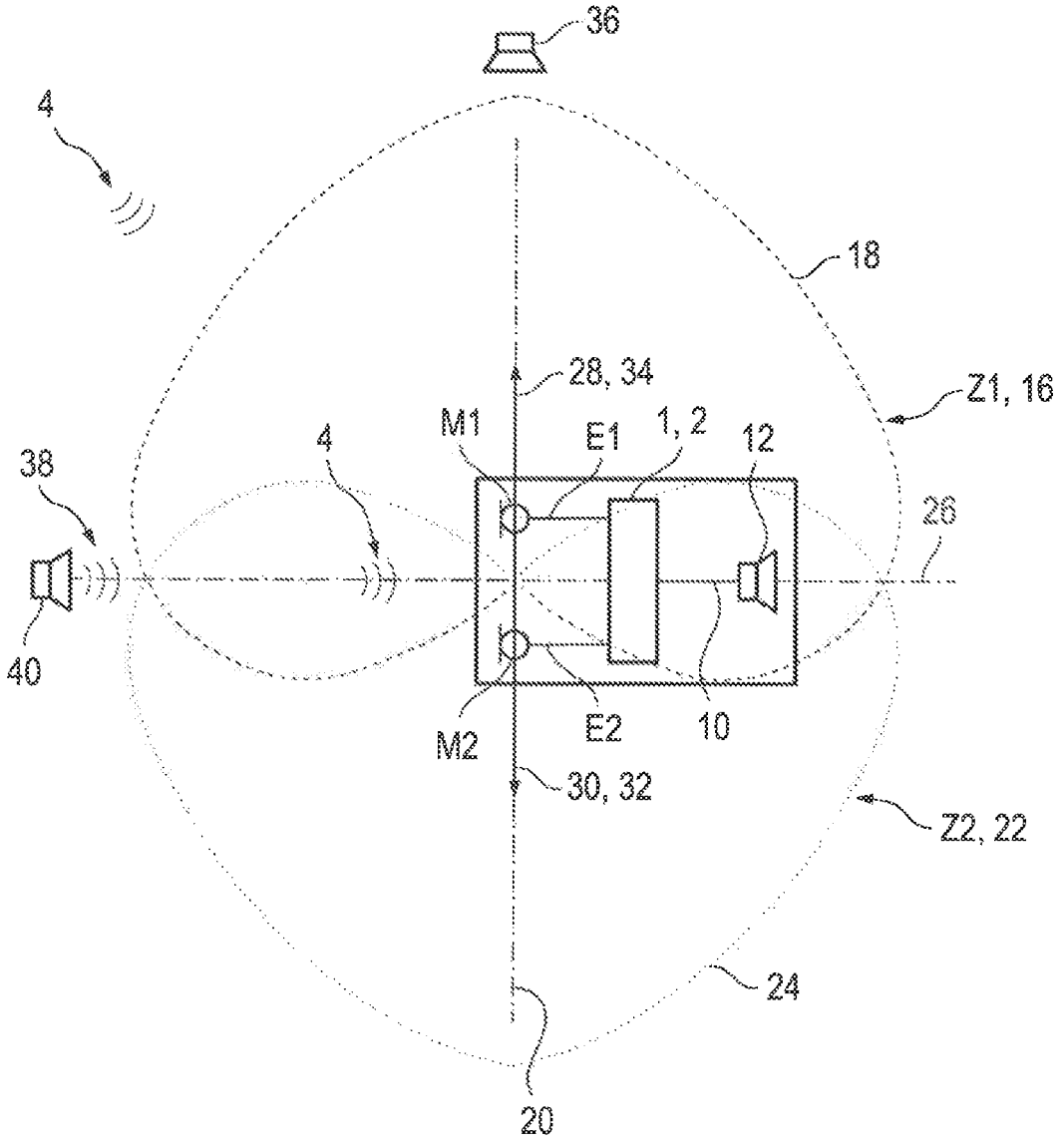
FIG. 1 shows a plan view of a hearing aid in an environment with a dominant useful signal source and an interference signal source.

Referring now to the figures of the drawing in detail and first, in particular, to FIG. 1 thereof, there is shown a schematic plan view of an acoustic system 1, which in the exemplary case is designed as a hearing aid 2. The hearing aid 2 has a first input transducer M1 and a second input transducer M2, which in this case are provided by microphones and are configured to generate a first input signal E1 and a second input signal E2 from an ambient sound 4. The input signals E1 and E2 are each fed to a control unit 6 for carrying out a method for directional signal processing yet to be described. The control unit 6 is implemented in this case on a signal processing device 8 of the hearing aid 2. In a manner yet to be described, an output signal 10 is generated by the signal processing device 8 based on the two input signals E1, E2 and is converted by an output transducer 12 of the hearing aid 2 into an output acoustic signal (not shown). The output transducer 12 in this case is provided by a loudspeaker.

Based on the first input signal E1 and the second input signal E2, a first intermediate signal Z1 is now generated (dashed line) by means of a time-delayed superposition. The first intermediate signal Z1 is generated as a cardioid signal 16, the directional characteristic 18 of which is ideally rotationally symmetrical about a connecting line 20 through the first input transducer M1 and the second input transducer M2 (in the drawing plane of FIG. 1 only one axis of symmetry with respect to the connecting line 20 can be seen). Likewise, from the first input signal E1 and the second input signal E2 a second intermediate signal Z2 is generated by a further, time-delayed superposition (dotted line). The second intermediate signal Z2 is generated here as an anti-cardioid signal 22, the directional characteristic 24 of which is also rotationally symmetrical about the connecting line 20. In addition, the first intermediate signal Z1 and the second intermediate signal Z2 are ideally mirror-symmetrical to each other with respect to a plane of symmetry 26 of the first input transducer M1 and the second input transducer M2 (in FIG. 1, a section of the symmetry plane 26 with the drawing plane is shown).

According to its directional characteristic 18, the first intermediate signal Z1 has a maximum sensitivity in a maximum direction 28 and a minimum sensitivity in a minimum direction 30 opposite to the maximum direction 28. In the minimum direction 30, the first intermediate signal Z1 ideally undergoes total attenuation. The maximum direction 28 and the minimum direction 30 run along the connecting line 20. According to its directional characteristic 24, the second intermediate signal Z2 has a maximum sensitivity in a maximum direction 32 and a minimum sensitivity in a minimum direction 34. The maximum direction 32 of the second intermediate signal Z2 coincides with the minimum direction 30 of the first intermediate signal Z1, the minimum direction 34 of the second intermediate signal Z2 coinciding with the maximum direction 28 of the first intermediate signal Z1.

The hearing aid 2 is designed in such a way that, if worn by a user as intended, the connection line 20 is aligned along the frontal direction of the user. A common situation when using the hearing aid 2 is that the user is in conversation with another person. Accordingly, he directs his view and thus his frontal direction to the interlocutor, whereby, due to the spatial associations just described, the maximum direction 28 of the first intermediate signal Z1 is also aligned to the interlocutor as the dominant useful signal source 36 (here schematically indicated by a loudspeaker symbol). If an interference signal 38 from an interference signal source 40 now occurs in the ambient sound, the said interference signal 38 is suppressed by means of adaptive directional microphones. Usually, from the first intermediate signal Z1 and the second intermediate signal Z2, a first superposition U1 of the form $$U1=Z1-a1\cdot Z2$$

is formed with a first superposition parameter a1 by minimizing the signal energy of the first superposition U1. Assuming that the maximum direction 28 of the first intermediate signal Z1 according to FIG. 1 is oriented toward the interlocutor as a useful signal source 36, and that the second intermediate signal Z2 in its minimum direction 34, which is also oriented toward the other interlocutor, undergoes total attenuation in the ideal case, if the signal energy is minimized as stated, the contribution of the interlocutor due to their assumed suppression by the second intermediate signal Z2 is not affected. The minimization of the signal energy thus only affects the interference signal 38 of the interference signal source 40.

Figure 2:
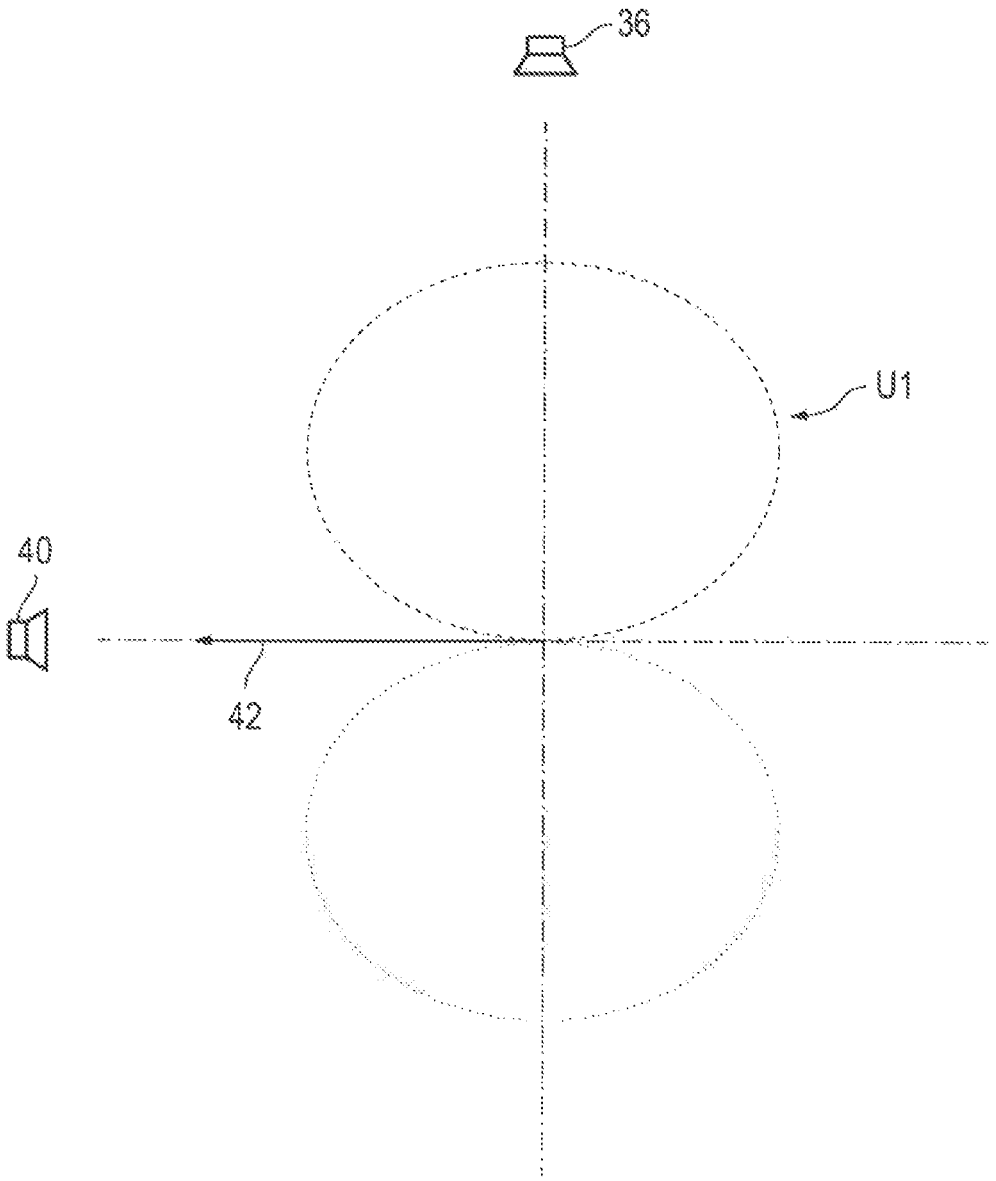
FIG. 2 shows a plan view of a suppression of the interference signal source by the hearing aid according to FIG. 1 by means of adaptive directional microphones.

For the situation shown in FIG. 1, where the interference signal source 40 is arranged at a right angle with respect to the frontal direction (and thus the direction of the useful signal source 36 or the maximum direction 28 of the first intermediate signal Z1 according to FIG. 1), for the first superposition U1, as shown by FIG. 2, this leads to a complete attenuation in a first target direction 42 aligned with the interference signal source 40. However, there are situations in which a total attenuation of the interference signal 38 of the interference signal source 40 in an output signal resulting from the described adaptive directional microphone is undesirable, for example for a pedestrian on the road where the ability to hear other road users in a timely manner is important for safety, but also in conversation situations with several interlocutors, where it may be advantageous to at least perceive the interjections of another interlocutor on whom the user is not currently concentrating (and thus not focusing his/her gaze), so that he/she can turn to them for attentive listening.

Figure 3:
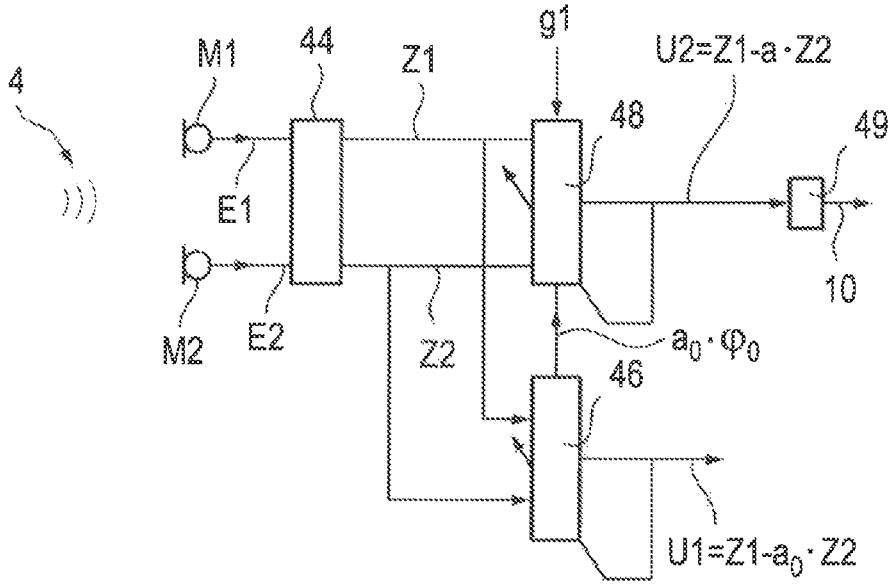
FIG. 3 shows a block diagram of a method for directional noise suppression for the hearing aid according to FIG. 1.

In order to achieve this, a method for directional signal processing is performed in the hearing aid 2 according to FIG. 1, which will be explained using FIG. 3 by means of a corresponding block diagram. As already shown in FIG. 1, the first input transducer M1 and the second input transducer M2 of the hearing aid 2 generate the first input signal E1 and the second input signal E2 respectively from the ambient sound 4. From the first input signal E1 and the second input signal E2, the first intermediate signal Z1 and the second intermediate signal Z2 are generated by a time-delayed superposition 44, which here is shown only schematically. The first intermediate signal Z1 is generated as the cardioid signal 16, the second intermediate signal Z2 as the anti-cardioid signal 22 according to FIG. 1.

To obtain information about the first target direction 42 of the interference signal source 40 according to FIG. 2 (and thus implicitly to determine the first target direction 42), the first superposition U1 is formed according to FIG. 2 from the first intermediate signal Z1 and the second intermediate signal Z2 by means of an adaptive directional microphone 46. The first superposition U1=Z1−$a_0$·Z2 provides for the present method a preliminary superposition parameter $a_0$ (which corresponds to the first superposition parameter a1 of the first superposition U1 according to FIG. 2), wherein the first target direction 42 of the interference signal source 40 according to FIG. 2 is also determined implicitly via the relationship with the first intermediate signal Z1 and the second intermediate signal Z2 using the preliminary superposition parameter $a_0$.

For said first target direction 42 a first value g1>0 of a gain is now specified, which should comprise a signal yet to be generated from the two intermediate signals Z1, Z2. In the first superposition U1, in the first target direction 42 as shown in FIG. 2, the gain is assumed to be zero (complete attenuation). Using an adaptive directional microphone 48, a second superposition U2=Z1−a·Z2 with the generally complex superposition parameter a is then formed from the first intermediate signal Z1 and the second intermediate signal Z2, specifically under the mentioned secondary condition of a gain of g1 in the first target direction 42, which is specified by the preliminary superposition parameter $a_0$ of the first superposition U1. From the second superposition U2, if necessary by means of further signal processing steps schematically symbolized by a signal processing block 49, such as frequency band-dependent amplification and/or compression, the output signal 10 is generated, which according to FIG. 1 is converted into an output sound signal by the output transducer 12.

From the knowledge that the first and the second intermediate signal Z1 or Z2 are given by the cardioid signal 16 or the anti-cardioid signal 22 according to FIG. 1, a transfer function G (ω, φ) of the second superposition U2 can be determined with respect to a sound signal incident from an angle φ (with respect to the frontal direction) (depending on the propagation time difference T between the two input transducers M1 and M2). This transfer function can be represented as $$G(\omega, \phi) = 2\left|\sin\frac{\omega T(1+\cos(\phi)}{2} - a\cdot\sin\frac{\omega T(1-\cos(\phi)}{2}\right|$$

Under the approximation ωT<<1, which is valid especially for low frequencies and propagation time differences T (for hearing aids, T is in the region of $10^{-5}$ s, the approximation is thus valid for large parts of the audible spectrum), the above formula can be approximated to $$G(\omega,\phi)=|\omega T(1+\cos\phi)-a\cdot\omega T(1-\cos\phi)| \quad \text{(i)}$$

In the frontal direction (i.e. for φ=0), G(ω, φ=0)=2ωT=2kd (with the distance d between the two input transducers M1 and M2 and the wave number k) is thus independent of a. It can now be shown that for a real superposition parameter a=$a_0$∈ ℝ the transfer function given in equation (i) becomes zero at an angle $\varphi_0$, for which the following applies:

$$a_0 = \frac{1+\cos\phi_0}{1-\cos\phi_0} \quad \text{or} \quad \cos\phi_0 = \frac{a_0-1}{a_0+1} \quad \text{(ii)}$$

For a generally complex superposition parameter a=aRe+i·aIm, the requirement of a gain of g1 in the first target direction $\varphi_0$ can be implemented by means of the transfer function (i) by appropriately equating the transfer function to g1. Due to the additional degree of freedom provided by the imaginary part aIm, the superposition parameter a is not yet fully defined by the first value g1 for the gain in the first target direction given by $a_0$. It can be shown that in the complex plane for aRe, aIm the permissible real and imaginary parts for a given first value g1, and a given first target direction 42 (and thus given $\varphi_0$ or $a_0$), form a circle around $a_0$ with radius g1$(a_0+1)$:

$$(aRe-a_0)^2+aIm^2=g1^2\cdot(a_0+1)^2 \quad \text{(iii)}$$

Several special cases can now arise, or be implemented accordingly for the second superposition U2.

Figure 4:
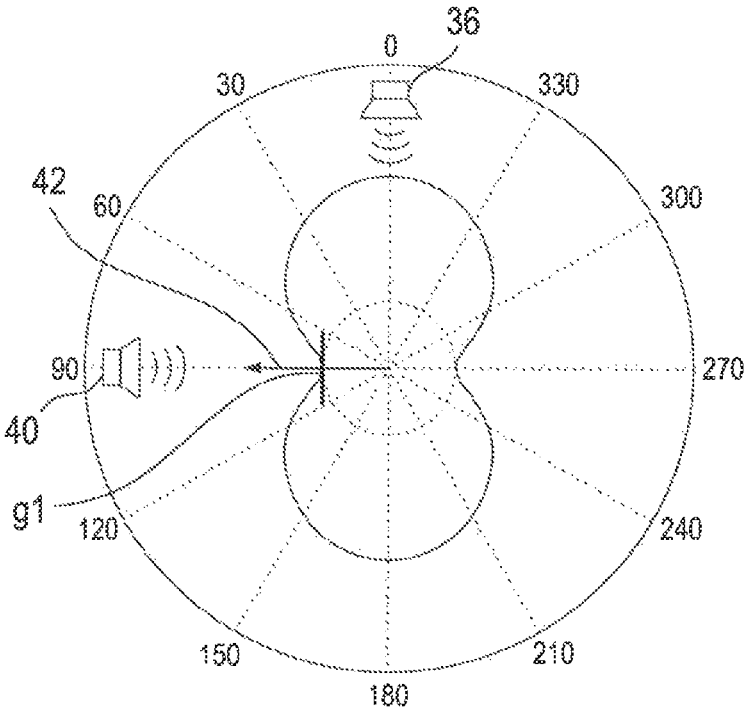
FIG. 4 shows a plan view of a directional characteristic for the directional noise suppression according to FIG. 3 under the secondary condition of a finite, globally minimum gain in a given direction.

As a secondary condition, it can be required that the gain in the first target direction 42 should additionally form a global minimum, which, however—unlike in the case shown in FIG. 2—should now no longer assume the value 0 but the first value g1>0. This is shown in FIG. 4.

By minimizing the squared magnitude of the transfer function according to equation (i) (with complex a), it is possible to determine the general angle φ for which the transfer function becomes a minimum. Inserting the so determined value of cos φ into the squared equation (i) first supplies the condition $$\cos(\phi)_{min} = -\frac{1-aRe^2-aIm^2}{(1+aRe)^2+aIm^2} \quad \text{(iv)}$$

and equating the transfer function with the required first value g1 for the (globally minimum) gain in the first target direction 42 supplies the dependency $$aIm=\pm(aRe+1)\cdot\sqrt{\varepsilon} \quad \text{(v)}$$

with $\varepsilon=g\mathbf{1}^2/(1-g\mathbf{1}^2)$. Inserting the intermediate result given in equation (v) into equation (iv) and representing the minimum angle min via the corresponding real-valued superposition parameter $a_0$ according to equation (iii) (for which at $\varphi_{min}$ the gain would disappear, i.e. $\varphi_{min}=\varphi_0$ and corresponding substitution from equation (iii)) produces $$aRe = \frac{a_0 - \varepsilon}{1 + \varepsilon}, \quad \text{(vi)}$$

so that the superposition parameter a=aRe+i·aIm, which forms the basis of the second superposition shown in FIG. 4, is obtained from the relationships given in equations (v) and (vi).

Figure 5:
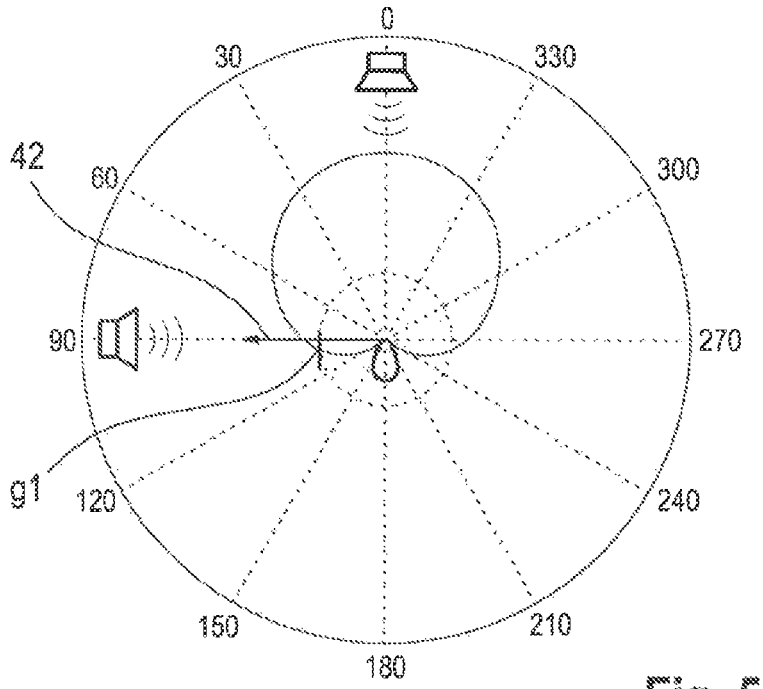
FIG. 5 shows a plan view of a directional characteristic of a directional noise suppression in a given direction under the secondary condition of a maximum directionality index.

Another possibility is illustrated by FIG. 5: here, it is not required that the gain in the second target direction should be a minimum, but that the resulting second superposition U2=Z1−a·Z2 should have a maximum directionality index (DI).

The DI can be determined from the squared magnitude of the transfer function in the maximum direction (i.e. in the maximum direction 28 of the first intermediate signal Z1 according to FIG. 1), normalized over the integral of the squared magnitude of the transfer function across all spatial directions. The DI is usually defined by the logarithm to base ten of the specified variables:

$$DI(\omega, \phi, \theta) = 10 \cdot \log_{10}\left(\frac{|G(\omega, \phi = 0, \theta = \pi/2)|^2}{\int d\Omega |G(\omega, \Omega)|^2}\right) \quad \text{(vii)}$$

where the integration in the denominator takes place over the normalized unit sphere, so that for an omnidirectional signal DI=0 is obtained. It can be shown that the DI according to equation (vi) can be represented as a function of the superposition parameter a=aRe+i·aIm as $$DI=-10\cdot\log_{10}(aRe^2-aRe+1+aIm^2)+10\cdot\log_{10}(3). \quad \text{(viii)}$$

The argument of the logarithm remains the same for aRe, aIm, which describe circles in the complex plane around the point (0.5, 0). For said point aRe=0.5, aIm=0, the DI has its maximum. In this case, the associated second superposition U2 forms a directional characteristic in the form of a hypercardioid. From equation (viii) and equation (iii) it is thus apparent that for $a_0\neq0$ and a superposition parameter a according to equation (iii), the DI according to equation (viii) is maximized by a real-valued superposition parameter a=aRe which is to be determined according to equation (iii), i.e.

$$aRe=a_0\pm g1\cdot(a_0+1) \quad \text{(ix)}$$

This results in the desired gain with the first value g1 in the first target direction 42, while in general in a second target direction 50 a total attenuation (i.e. a gain with a second value g2=0) occurs.

The plus sign in equation (ix) applies for $a_0<0.5$, the minus sign for $a_0>0.5$. In order to avoid discontinuities for aRe in the case of a moving noise source 40 and thus variable $a_0$ in the environment of $a_0=0.5$, a regularization can be carried out in a manner yet to be described (not shown in detail), which for a range $a_0\leq0.5-d1$ and a range $a_0\geq0.5+d2$, with d1, d2>0, preferably d1=d2 and particularly preferably d1, d2<<1, initially provides the value for aRe according to equation (ix). In the range $0.5-d1<a_0<0.5$ and $0.5<a_0<0.5+d2$, a non-vanishing imaginary part aIm #0 can be applied such that the real part aRe resulting from equation (iii) runs along the maximum gradient of the DI according to equation (ix). It can be shown that this is the case when for $a_0=0.5$ the value $aRe=(1-3\cdot g\mathbf{1}^2)/2$ is passed through.

Figure 6:
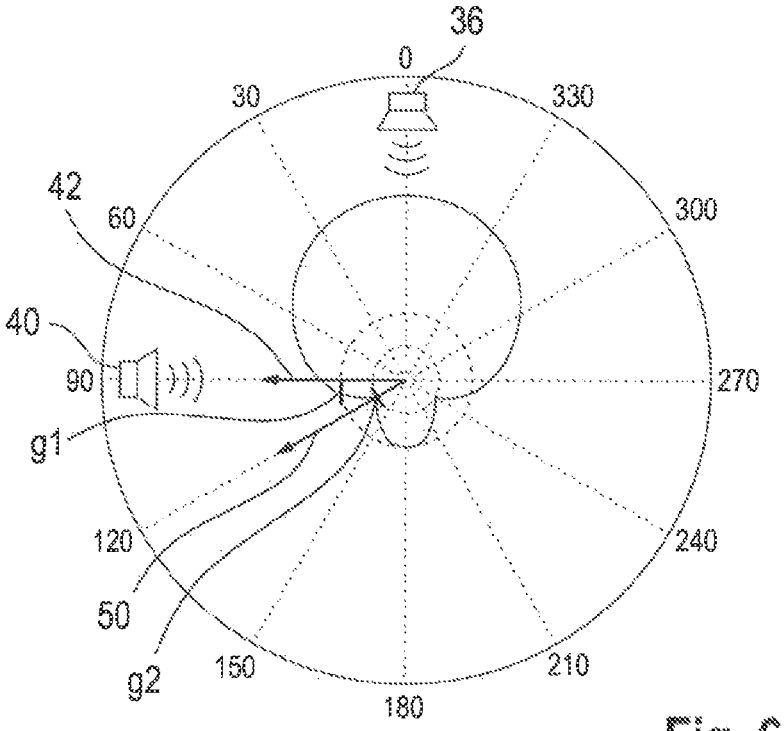
FIG. 6 shows a plan view of a directional characteristic of a directional noise suppression with a given noise suppression in a given direction and a given minimum gain.

A further possibility is illustrated in FIG. 6. There, the superposition parameter a for the second superposition U2 is determined in such a way that a gain with the value g1 occurs in the first target direction 42. Furthermore, a second value of g2<g1 is specified as the global minimum for the gain, which should not be undershot in any direction. In particular, there is a second target direction 50, in which the gain, i.e. the gain factor, assumes exactly the second value g2. In this case, the additional degree of freedom of the imaginary part aIm in the superposition parameter a is used to specify, in addition to a predefined first value g1 of a gain in a first direction, the second value g2 which the gain must not fall below in any direction.

In order to determine the superposition parameter a, the relationship between the real and imaginary part given in equation (v) for a minimum, finite gain must be inserted into the general equation (iii) for a specification of the first value g1, however, in this case the parameter $\varepsilon=g\mathbf{2}^2/(1-g\mathbf{2}^2)$ must be used to allow for the second value g2 of the gain, which is now intended to form the global minimum (in equation (v), the global minimum was given by the first value g1, which now determines the gain in the first target direction).

This results in a quadratic equation for the real part aRe of the superposition parameter a, the positive or negative solution of which is chosen depending on the value of $a_0$ ($a_0>0.5$ or $a_0<0.5$) and thus depending on the first target direction 42 in which the first value g1 of the gain is defined. In an immediate environment of $a_0=0.5$, a regularization of the type already described in FIG. 5 can be carried out in order to avoid discontinuities. The imaginary part aIm can then be determined using equation (v) (with $\varepsilon=g\mathbf{2}^2/(1-g\mathbf{2}^2)$).

Although the invention has been illustrated and described in greater detail by means of the preferred exemplary embodiment, the invention is not restricted by the examples disclosed and other variations can be derived therefrom by the person skilled in the art without departing from the scope of protection of the invention.

The following is a summary list of reference numerals and the corresponding structure used in the above description of the invention:

1 acoustic system
2 hearing aid
4 ambient sound
6 control unit
8 signal processing device
10 output signal
12 output transducer
16 cardioid signal
18 directional characteristic (of the first intermediate signal)
20 connecting line
22 anti-cardioid signal
24 directional characteristic (of the second intermediate signal)
26 plane of symmetry
28 maximum direction (of the first intermediate signal)
30 minimum direction (of the first intermediate signal)
32 maximum direction (of the second intermediate signal)
34 minimum direction (of the second intermediate signal)

36 useful signal source
38 interference signal
40 interference signal source
42 first target direction
44 time-delayed superposition
46 adaptive directional microphone
18 adaptive directional microphone
50 second target direction
a superposition parameter
$a_0$ preliminary superposition parameter
E1, E2 first, second input signal
g1, g2 first, second value (of the gain)
M1, M2 first, second input transducer
U1, U2 first, second superposition
Z1, Z2 first, second intermediate signal

The invention claimed is:

1. A method for directional signal processing in an acoustic system, the method comprising:

generating a first input signal from an ambient sound with a first input transducer of the acoustic system;

generating a second input signal from the ambient sound with a second input transducer of the acoustic system;

using the first input signal and the second input signal to generate a first intermediate signal and a second intermediate signal, respectively;

obtaining a preliminary superposition parameter for a first superposition of the first intermediate signal and the second intermediate signal to form the first superposition with an attenuation having a maximum in a first target direction;

forming with the preliminary superposition parameter a superposition parameter such that a second superposition of the first intermediate signal and the second intermediate signal, formed in the first target direction using the superposition parameter, has a prespecified first value for a gain that is greater than zero; and forming an output signal of the acoustic system using the second superposition.

2. The method according to claim 1, which comprises generating the first intermediate signal as a cardioid signal and generating the second intermediate signal as an anti-cardioid signal.

3. The method according to claim 1, which comprises forming the superposition parameter so that, for the second superposition, the gain in the first target direction has a global minimum with the prespecified first value.

4. The method according to claim 3, wherein:

a real part of the superposition parameter is formed from a linear function of the preliminary superposition parameter, dependent on the first value of the gain in the first target direction, with the function merging into the preliminary superposition parameter when the first value approaches zero; and/or an imaginary part of the superposition parameter is linearly dependent on the real part, and approaches zero when the first value approaches zero.

5. The method according to claim 1, which comprises forming the superposition parameter in such a way that for the second superposition the gain in the first target direction has the prespecified first value and the gain in a second target direction has a prespecified second value.

6. The method according to claim 5, wherein the second value is less than the first value.

7. The method according to claim 5, wherein the second value is equal to zero.

8. The method according to claim 5, wherein the real part and the imaginary part of the superposition parameter are described by a circle in a complex plane with the preliminary superposition parameter as origin and a radius, which has a square that is quadratically dependent on the first value of the gain and quadratically dependent on the preliminary superposition parameter.

9. The method according to claim 5, which comprises forming the superposition parameter in such a way that a signal resulting from the second superposition has a maximum directionality index.

10. The method according to claim 9, which comprises, in a given environment of the preliminary superposition parameter around a critical value, carrying out a regularization of the superposition parameter such that:

a value of the superposition parameter to be applied is specified for the critical value of the preliminary superposition parameter; and for values from the specified environment around the critical value, the preliminary superposition parameter is continuously mapped to the superposition parameter.

11. The method according to claim 5, wherein:

the superposition parameter is formed so that for the second superposition the gain in the first target direction has the prespecified first value and has a prespecified second value in a second target direction; and the gain in the second target direction has a global minimum with the prespecified second value.

12. An acoustic system, comprising:

a first input transducer for generating a first input signal from an ambient sound;

a second input transducer for generating a second input signal from the ambient sound; and a control unit configured for carrying out the method according to claim 1.

13. The acoustic system according to claim 12, comprising a hearing aid having said first input transducer and said second input transducer.

* * * * *